US009728911B2

(12) United States Patent
Vaccaro

(10) Patent No.: US 9,728,911 B2
(45) Date of Patent: Aug. 8, 2017

(54) DIELECTRIC SPACER FOR COAXIAL CABLE AND CONNECTOR

(71) Applicant: CommScope Technologies LLC, Hickory, NC (US)

(72) Inventor: Ronald A. Vaccaro, Shorewood, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/228,870

(22) Filed: Aug. 4, 2016

(65) Prior Publication Data

US 2017/0040754 A1 Feb. 9, 2017

Related U.S. Application Data

(60) Provisional application No. 62/201,729, filed on Aug. 6, 2015.

(51) Int. Cl.
*H01R 24/38* (2011.01)
*H01R 103/00* (2006.01)

(52) U.S. Cl.
CPC ..... *H01R 24/38* (2013.01); *H01R 2103/00* (2013.01)

(58) Field of Classification Search
CPC ..... H01R 24/38; H01R 2103/00
USPC ..... 439/578–595
See application file for complete search history.

(56) References Cited

U.S. PATENT DOCUMENTS 5,704,809 A * 1/1998 Davis ..... H01R 13/434 439/349
6,217,380 B1 4/2001 Nelson et al.
2005/0277331 A1* 12/2005 Hall ..... H01R 24/542 439/578
2008/0170346 A1 7/2008 Swearingen
2008/0311788 A1* 12/2008 Vaccaro ..... H01R 9/0521 439/578
2009/0029590 A1 1/2009 Sykes et al.
2013/0109228 A1* 5/2013 Sykes ..... H01R 9/0515 439/578
2013/0157503 A1* 6/2013 Sykes ..... H01R 24/44 439/578
2013/0157504 A1* 6/2013 Sykes ..... H01R 24/44 439/578
2015/0200469 A1 7/2015 Vaccaro

FOREIGN PATENT DOCUMENTS

JP 11-354219 A 12/1999

OTHER PUBLICATIONS

International Search Report Corresponding to International Application No. PCT/US2016/044422, Dated: Nov. 8, 2016; 10 Pages.

* cited by examiner

*Primary Examiner* — Harshad Patel
(74) *Attorney, Agent, or Firm* — Myers Bigel, P.A.

(57) ABSTRACT

A dielectric spacer for a coaxial connector includes: a narrow ring; a wide ring attached to the narrow ring, the wide and narrow rings sharing a longitudinal axis; a plurality of posts positioned within the wide ring, each of the posts extending substantially parallel to the longitudinal axis; and a plurality of bores in the narrow ring, each of the bores extending substantially parallel with the longitudinal axis and being aligned with a corresponding post. Each of the posts is mounted on a frangible section that separates the post from its corresponding bore.

16 Claims, 3 Drawing Sheets

DIELECTRIC SPACER FOR COAXIAL CABLE AND CONNECTOR

RELATED APPLICATION

The present application claims priority from and the benefit of U.S. Provisional Patent Application No. 62/201,729, filed Aug. 6, 2015, the disclosure of which is hereby incorporated herein in its entirety.

FIELD OF THE INVENTION

The present invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include a structure such as a pin or post connected to an inner conductor of the coaxial cable and an outer conductor body connected to the outer conductor of the coaxial cable; these are mated with a mating sleeve (for the pin or post of the inner conductor) and another outer conductor body of a second connector. Coaxial connector interfaces often utilize a threaded coupling nut or other retainer that draws the connector interface pair into secure electro-mechanical engagement when the coupling nut (which is captured by one of the connectors) is threaded onto the other connector. The pin/post and outer conductor body are typically separated with one or more dielectric spacers.

SUMMARY

As a first aspect, embodiments of the invention are directed to a dielectric spacer for a coaxial connector, comprising: a narrow ring; a wide ring attached to the narrow ring, the wide and narrow rings sharing a longitudinal axis; a plurality of posts positioned within the wide ring, each of the posts extending substantially parallel to the longitudinal axis; and a plurality of bores in the narrow ring, each of the bores extending substantially parallel with the longitudinal axis and being aligned with a corresponding post. Each of the posts is mounted on a frangible section that separates the post from its corresponding bore.

As a second aspect, embodiments of the invention are directed to a method of inserting a dielectric spacer in an outer conductor body, comprising the steps of:

(a) providing a dielectric spacer comprising: a narrow ring; a wide ring attached to the narrow ring, the wide and narrow rings sharing a longitudinal axis; a plurality of posts positioned within the wide ring, each of the posts extending substantially parallel to the longitudinal axis; and a plurality of bores in the narrow ring, each of the bores extending substantially parallel with the longitudinal axis and being aligned with a corresponding post; wherein each of the posts is mounted on a frangible section that separates the post from its corresponding bore;

(b) providing an outer conductor body having an internal cavity;

(c) engaging the posts with a push tool; and (d) pushing the posts with the push tool along the longitudinal axis to advance the dielectric spacer into the cavity of the outer conductor body.

As a third aspect, embodiments of the invention are directed to a combination, comprising an outer body for a coaxial connector and a dielectric spacer for a coaxial connector. The dielectric spacer comprises: a narrow ring; a wide ring attached to the narrow ring, the wide and narrow rings sharing a longitudinal axis; and a plurality of bores in the narrow ring, each of the bores extending substantially parallel with the longitudinal axis and being aligned with a corresponding post.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
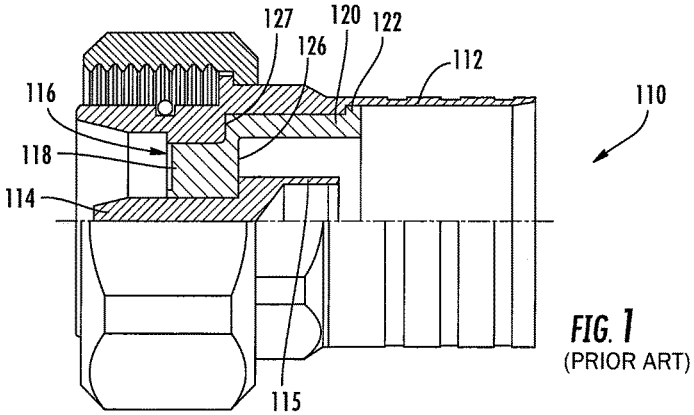
FIG. 1 (PRIOR ART)
FIG. 1 is a partial section view of a conventional coaxial connector with a prior dielectric spacer of a first configuration.
Figure 2:
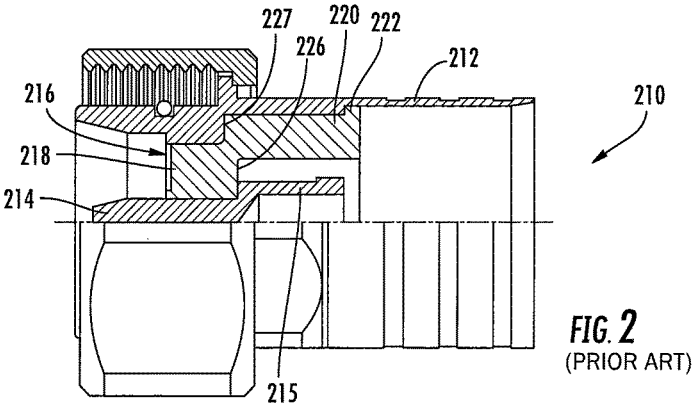
FIG. 2 (PRIOR ART)
FIG. 2 is a partial section view of a conventional coaxial connector with a prior dielectric spacer of a second configuration.

Referring now to the figures, two conventional coaxial connectors are shown in FIGS. 1 and 2 and are designated, respectively, at 110 and 210. The connectors 110, 210 include respective outer conductor bodies 112, 212, inner contacts 114, 214 and dielectric spacers 116, 216. Each of the dielectric spacers 116, 216 includes a narrower ring 118, 218 that merges with a wider ring 120, 220, with a rim 122, 222 encircling the free end of the wider ring 120, 220, a surface 126, 226 extending between the inner diameters of the narrower rings 118, 218 and the wider rings 120, 220, and a shoulder 127, 227 positioned between the narrower and wider rings 118, 218, 120, 220. As can be seen by comparing FIGS. 1 and 2, the inner surfaces of the outer conductor bodies 112, 212 are very similar, such that the narrower rings 118, 218 and the wider rings 120, 220 have the same outer diameters. However, the inner contacts 114, 214 differ, particularly in the regions 115, 215 that interface with the inner conductor of a coaxial cable. As a result, the dimensions of the dielectric spacers 116, 216 in those regions (and particularly the inner diameters of the wider rings 120, 220) differ in order to accommodate the differences in physical size and electrical properties (especially impedance) of the inner contacts 114, 214 and outer conductor bodies 112, 212 in these locations. More specifically, the dielectric spacers 116, 216 should be dimensioned so that an impedance of approximately 50 ohms is present in this region.

Figure 3:
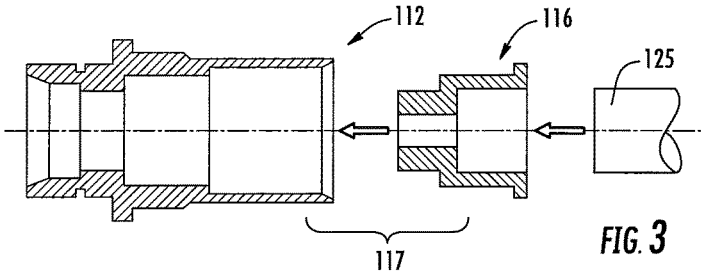
FIG. 3 is an exploded section view of the coaxial connector of FIG. 1 illustrating the use of a push tool to insert the dielectric spacer into the outer conductor body of the coaxial connector.

Referring now to FIG. 3, the assembly of the dielectric spacer 116 in the outer conductor body 112 is illustrated. The spacer 116 is aligned with the outer conductor body 112, and a push tool 125 is employed to force the spacer 116 into a tight fit within the cavity of the outer conductor body 112. Once in place, the assembly 117 of the outer conductor body 112 and the spacer 116 is employed in subsequent steps in the manufacturing process. A similar process is used to insert the dielectric spacer 216 into the outer conductor body 212.

Figure 4:
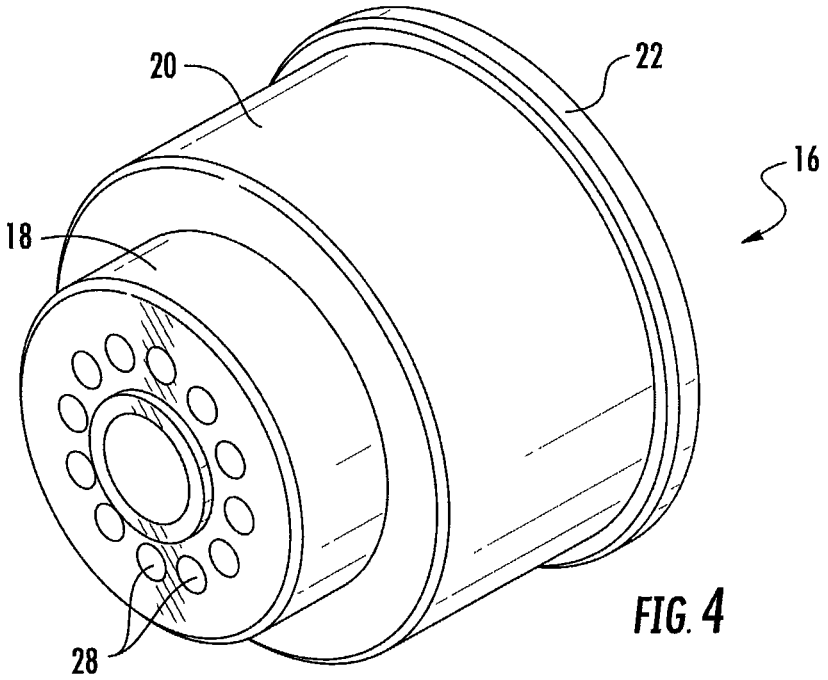
FIG. 4 is a front perspective view of a dielectric spacer for a coaxial connector according to embodiments of the invention.
Figure 5:
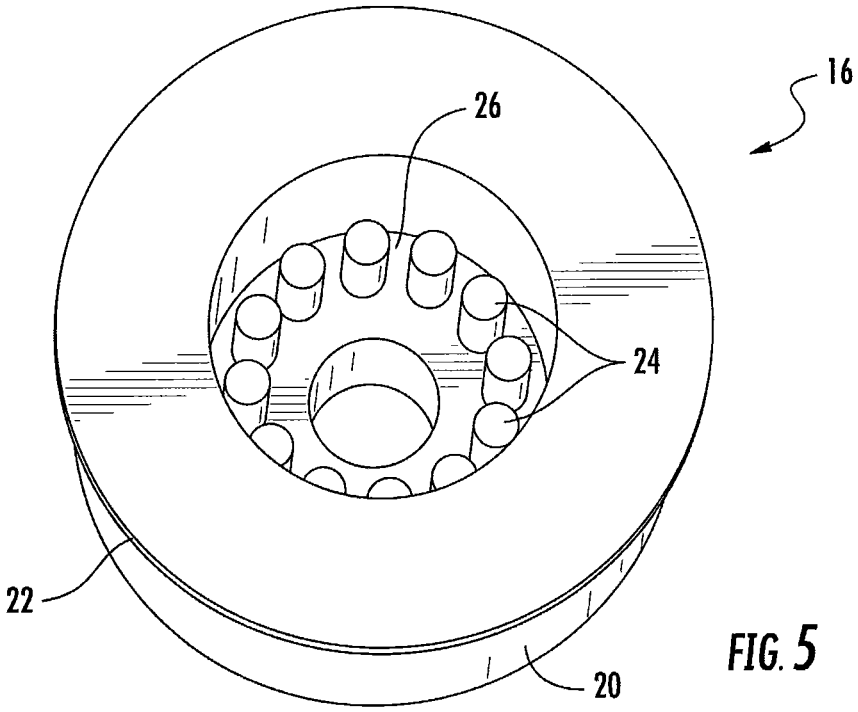
FIG. 5 is a rear perspective view of the dielectric spacer of FIG. 4.
Figure 6:
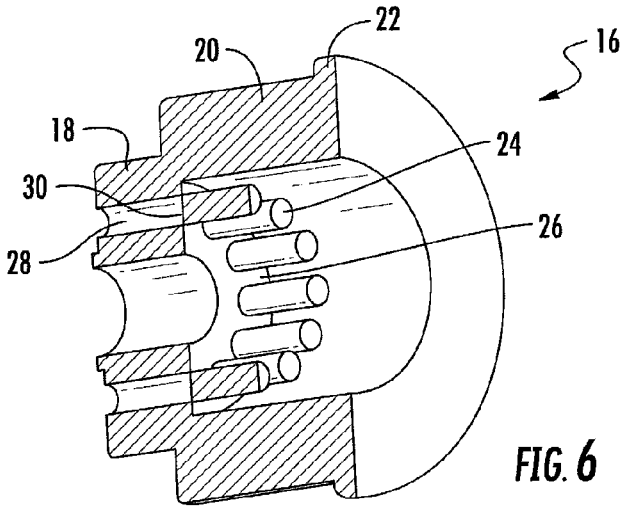
FIG. 6 is a perspective section view of the dielectric spacer of FIG. 4.

A dielectric spacer that can be employed with either connector 110, 210 is shown in FIGS. 4-6 and is designated broadly at 16. The spacer 16 has many of the same features as the spacer 116: it includes a narrower ring 18 that merges with a wider ring 20, with a rim 22 encircling the free end of the wider ring 20, and a surface 26 positioned between the inner diameters of the narrower and wider rings 18, 20. However, the spacer 16 also includes a plurality of longitudinally-extending posts 24 that extend away from the shoulder 26 within the wider ring 22. Also, a plurality of longitudinally-extending bores 28 are formed in the narrower ring 18. Each of the bores 28 is coaxial with one of the posts 24 and is separated from its corresponding post 24 by a thin frangible section 30.

The spacer 16 is typically formed of a dielectric material, such as a polymeric material. An exemplary material is polyetherimide, which is available from Saudi Basic Industries Corp. under the tradename ULTEM®. In some embodiments, it may be desirable to select a material having a dielectric constant between about 2.0 and 5.0, and typically higher than about 2.5.

Figure 7:
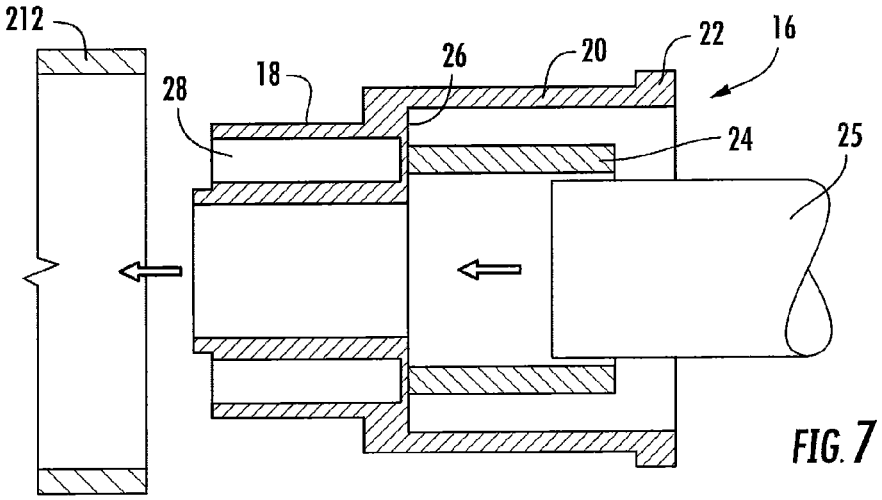
FIG. 7 is a section view of the dielectric spacer of FIG. 4 being inserted into the outer conductor body of a first coaxial connector with a first push tool.

Referring now to FIG. 7, the spacer 16 can be inserted into the outer conductor body 212 of the connector 210 in the same manner as described above through the use of a push tool 25. The outer diameter of the push tool 25 fits within the circle defined by the posts 24 and the end of the push tool 25 presses against the surface 26, which enables a technician to press the spacer 16 into place within the outer conductor body 212.

Figure 8:
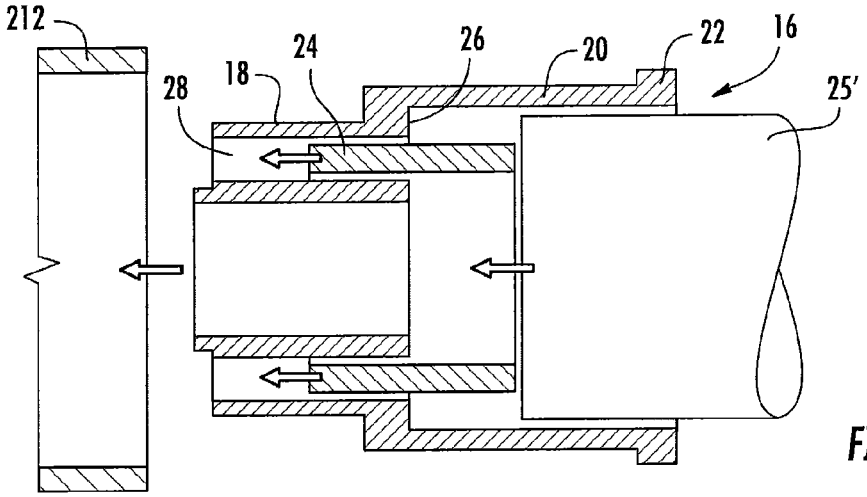
FIG. 8 is a section view of the dielectric spacer of FIG. 4 being inserted into the outer conductor body of a second coaxial connector with a second push tool.

Referring now to FIG. 8, the spacer 16 can also be used with the outer conductor body 112. A push tool 25' with an outer diameter that is wider than the circle defined by the posts 24 but narrower than the inner diameter of the wider ring 22 is used. The push tool 25' is positioned to contact the ends of the posts 24. The push tool 25' is used to press the spacer 16 into place within the outer conductor body 112. Once the spacer 16 has "bottomed out" against the outer conductor body 112, continued pressure applied on the posts 24 with the push tool 25' causes the frangible sections 30 separating the posts 24 from their corresponding bores 28 to fracture. Pressure from the push tool 25' and/or gravity forces each post 24 into and through its corresponding bore 28; the posts 24 can be removed from the bores 28 by shaking, agitation, or the like, or they may simply fall through the bores 28. Once the posts 24 are removed from the bores 28, the spacer 16 is in place in the outer conductor body 112.

Those skilled in this art will appreciate that the posts 24 may be projections of virtually any cross-sectional shape (e.g., round, square, oval, rectangular, triangular, or the like), and may differ in number from that shown (correspondingly, the number of bores 28 would differ also). Further, the posts 24 may be mounted on frangible sections 30 that are coplanar with the shoulder 26, or may be mounted on frangible sections 30 that are offset slightly from the shoulder 26, so that the frangible sections 30 are more easily fractured by the push tool. Also, the posts 24 are illustrated as being shorter than the wider ring 20, but in some embodiments the posts 24 may extend to the same length as or be longer than the wider ring 20.

Also, the sizes and positions of the posts 24 and bores 28 and the dimensions of the narrower and wider rings 20, 22 should be selected to provide a desired impedance to the connectors 110, 210. In one embodiment, the posts 24 (twelve in number) are circular in cross-section and have a diameter of about 0.060 inch, the narrower ring 18 has an inner diameter of 0.122 inch and a thickness of 0.135 inch, the wider ring 20 has an inner diameter of 0.423 inch and a thickness of 0.060 inch, and the spacer 16 is formed of PEI having a dielectric constant of about 3.1. This arrangement can produce an impedance of about 50 ohms when (a) the dielectric spacer 16 is used in intact form with the outer conductor body 212 and inner contact 214 and (b) the dielectric spacer 16 is used with the posts 24 removed with the outer conductor body 112 and the inner contact 114. Other variations of dimensions and/or material will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A dielectric spacer for a coaxial connector, comprising:
a narrow ring;
a wide ring attached to the narrow ring, the wide and narrow rings sharing a longitudinal axis;
a plurality of posts positioned within the wide ring, each of the posts extending substantially parallel to the longitudinal axis;
a plurality of bores in the narrow ring, each of the bores extending substantially parallel with the longitudinal axis and being aligned with a corresponding post;
wherein each of the posts is mounted on a frangible section that separates the post from its corresponding bore.

2. The dielectric spacer defined in claim 1, wherein the posts define a circle having a center on the longitudinal axis.

3. The dielectric spacer defined in claim 1, formed via injection molding.

4. The dielectric spacer defined in claim 1, formed from a polymeric material.

5. The dielectric spacer defined in claim 1, in combination with an outer conductor body of a coaxial connector.

6. The dielectric spacer defined in claim 1, wherein the spacer is formed of a material having a dielectric constant of between about 2.0 and 5.0.

7. A method of inserting a dielectric spacer in an outer conductor body, comprising the steps of:
(a) providing a dielectric spacer comprising:
a narrow ring;
a wide ring attached to the narrow ring, the wide and narrow rings sharing a longitudinal axis;
a plurality of posts positioned within the wide ring, each of the posts extending substantially parallel to the longitudinal axis;
a plurality of bores in the narrow ring, each of the bores extending substantially parallel with the longitudinal axis and being aligned with a corresponding post;
wherein each of the posts is mounted on a frangible section that separates the post from its corresponding bore;
(b) providing an outer conductor body having an internal cavity;
(c) engaging the posts with a push tool; and
(d) pushing the posts with the push tool along the longitudinal axis to advance the dielectric spacer into the internal cavity of the outer conductor body.

8. The method defined in claim 7, further comprising the step of pushing the posts with sufficient force that the frangible sections fracture and the posts travel into and through the bores.

9. The method defined in claim 8, wherein step (d) includes the step of pushing the posts with sufficient force to fracture the frangible sections.

10. The method defined in claim 7, wherein the posts define a circle having a center on the longitudinal axis.

11. The method defined in claim 7, wherein the dielectric spacer is formed via injection molding.

12. The method defined in claim 7, wherein the dielectric spacer is formed from a polymeric material.

13. The method defined in claim 7, wherein a material has a dielectric constant of between about 2.0 and 5.0.

14. A combination, comprising:
an outer body for a coaxial connector; and
a dielectric spacer for the coaxial connector, comprising:
a narrow ring;
a wide ring attached to the narrow ring, the wide and narrow rings sharing a longitudinal axis; a plurality of posts positioned within the wide ring, each of the posts extending substantially parallel to the longitudinal axis the coaxial connector; and
a plurality of bores in the narrow ring, each of the bores extending substantially parallel with the longitudinal axis and being aligned with a corresponding post.

15. The combination defined in claim 14, wherein each of the posts is mounted on a frangible section that separates the post from its corresponding bore.

16. The combination defined in claim 14, wherein the spacer is formed of a material having a dielectric constant of between about 2.0 and 5.0.

* * * * *